US006234062B1

(12) United States Patent
Griffin

(10) Patent No.: US 6,234,062 B1
(45) Date of Patent: May 22, 2001

(54) TELESCOPIC PISTON

(75) Inventor: Dennis Griffin, Guildford (GB)

(73) Assignee: MBM Technology Limited, Brighton (GB)

( * ) Notice: Subject to any disclaimer, the term of this patent is extended or adjusted under 35 U.S.C. 154(b) by 0 days.

(21) Appl. No.: 09/260,753

(22) Filed: Mar. 2, 1999

(30) Foreign Application Priority Data

Mar. 5, 1998 (GB) ..... 9804701

(51) Int. Cl.[7] ..... F15B 15/26; F01B 7/20
(52) U.S. Cl. ..... 92/23; 92/53
(58) Field of Search ..... 92/15, 22, 23, 92/24, 25, 26, 51, 52, 53

(56) References Cited

U.S. PATENT DOCUMENTS

| | | | | |
|---|---|---|---|---|
| 668,321 | * | 2/1901 | Sonnex | 92/51 X |
| 1,799,298 | * | 4/1931 | Jakob | 92/52 X |
| 3,010,752 | * | 11/1961 | Geffner | 92/51 X |
| 3,186,308 | * | 6/1965 | Butterworth | 92/51 X |
| 3,426,651 | * | 2/1969 | Arendarski | 92/26 |
| 3,614,912 | * | 10/1971 | Nepp | 92/25 |
| 3,958,376 | * | 5/1976 | Campbell | 92/53 X |
| 4,075,929 | * | 2/1978 | Peterson | 92/51 X |
| 4,088,287 | * | 5/1978 | Hasquenoph et al. | 244/137.4 |
| 4,388,853 | * | 6/1983 | Griffin et al. | 89/1.57 |
| 4,466,334 | * | 8/1984 | Holtrop | 92/26 X |
| 4,511,117 | * | 4/1985 | Soderstrom | 92/25 X |
| 4,850,553 | | 7/1989 | Takata et al. | 244/137.4 |
| 5,850,713 | * | 12/1998 | Hojo | 92/52 X |
| 6,073,886 | * | 6/2000 | Jakubowski, Jr. et al. | 244/137.4 |

FOREIGN PATENT DOCUMENTS 2 078 912 2/1983 (GB) .

* cited by examiner

*Primary Examiner*—John E. Ryznic
(74) *Attorney, Agent, or Firm*—Dean W. Russell; Kilpatrick Stockton LLP

(57) ABSTRACT

A telescopic piston assembly comprises a housing 1 containing an inner component 2, an intermediate component 3 and an outer component 6, all telescopingly interfitted together. The inner component 2 comprises a fluid outlet at one end, the intermediate component 3 making a sliding seal 5 with the inner component 2 and comprising a closed end surrounding the fluid outlet end. The outer component 6 makes a first sliding seal (12, FIG. 7) with the intermediate component 3 and a second sliding seal 13 with the inner component. A detent 4 operates to hold the outer component 6 in an extended position relative to the inner component 3.

5 Claims, 6 Drawing Sheets

TELESCOPIC PISTON

This invention relates to fluid actuators and particularly although not exclusively pneumatic or gas powered actuators. High speed actuators are often energised by compressed gas when high forces and speed of actuation are vital, such as in emergency release, ejection or actuation systems.

A major problem with such systems which use a discrete volume of pressurised gas, is the large gas storage receiver needed to maintain a reasonably sustained pressure as the internal swept volume of the actuator increases during its stroke. The measures of effectiveness are the energy efficiency and thrust efficiency of the system, and the velocity imparted to an inertial load.

In the following examples, the maximum permitted force is assumed to be 22 kN, the inertial load (ejection mass) a mass of 153 kg and the gas reservoir is 500 ml at an initial pressure of 20 MPa. These might be typical values for an ejector ram pressurised by compressed air or nitrogen.

Figure 1A:
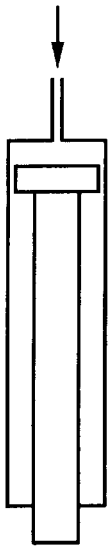
Figure 1B:
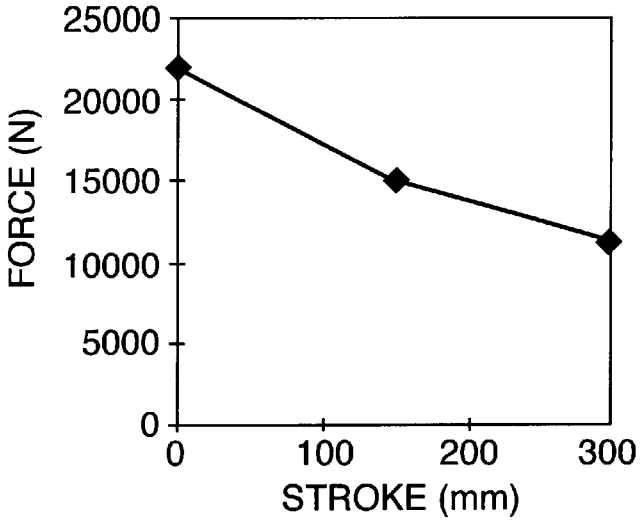

Under these conditions a typical approximated force/stroke diagram for a single stage 20 compact ram such as is schematically shown in FIG. 1*a* appears in FIG. 1*b*. The thrust efficiency, expressed as the equivalent average force divided by the peak force, is summarised in Table 1, together with the energy efficiency expressed as the expansion work done by the gas divided by the total energy available from adiabatic expansion of the gas to zero relative pressure. The importance of the peak force is that it is usually limited by the physical properties of the item being ejected or the allowable reaction force which can be tolerated by the launch platform Energy efficiency is important in achieving a high ejection mass final velocity from a given volume of compressed gas.

TABLE 1

| | |
|---|---|
| Work done first portion (i.e. 0–approx. 150 mm stroke) = | 2676 j |
| Work done second portion (i.e. approx. 150–300 mm stroke) = | 1859 j |
| Total work done = | 4535 j |
| Mass final velocity = | 7.70 m/s |
| Average effective force = | 15120 N |
| Peak force/Average effective force = | 1.45 |
| Peak acceleration = | 144 $m/s^2$ |
| Peak 'g' = | 14.7 'g' |
| Thrust efficiency = | 68.7% |
| Energy efficiency = | 22.7% |

Greater energy (and hence final mass velocity) may be extracted from the gas by lengthening the cylinder and piston (FIG. 2*a*), if space permits. The result is of the form shown in FIG. 2*b*, and will be seen to exhibit degraded trust efficiency in exchange for the improved energy efficiency (Table 2). However, space is often at a premium in emergency release installations, and also, the slender ram which results, will be subjected to lateral forces at its end during extension, and for sufficient robustness will need to be excessively heavy.

Therefore, this option is generally not used.

TABLE 2

| | |
|---|---|
| Work done first portion = | 4428 j |
| Work done second portion = | 2466 j |
| Total work done = | 6894 j |
| Mass final velocity = | 9.49 m/s |
| Average effective force = | 11890 N |
| Peak force/Average effective force = | 1.85 |

TABLE 2-continued

| | |
|---|---|
| Peak acceleration = | 144 $m/s^2$ |
| Peak 'g' = | 14.7 'g' |
| Thrust efficiency = | 54.0% |
| Energy efficiency = | 34.5% |

Figure 3A:
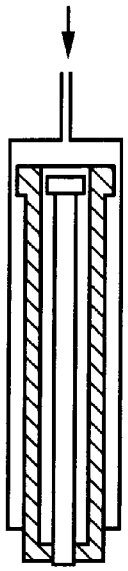

Telescopic piston assemblies are used to obtain greater ram stroke, and hence energy output, from a given actuator installed length. In their simplest form as shown in FIG. 3*a*, their lateral stiffness is good because, if the sequence of extension is unrestrained, the high initial gas pressure acts on the largest piston area first, and as the gas expands, its reduced pressure then acts on the smallest area. But for the same reasons the thrust and energy efficiencies are poor. Nonetheless, a modest increase in energy output/installed length is obtained. The results are of the general form shown in FIG. 3*b* and Table 3.

TABLE 3

| | |
|---|---|
| Work done first stage = | 4535 j |
| Work done second stage = | 1051 j |
| Total work done = | 5586 j |
| Mass final velocity = | 8.54 m/s |
| Average effective force = | 9630 N |
| Peak force/Average effective force = | 2.28 |
| Peak acceleration = | 144 $m/s^2$ |
| Peak 'g' = | 14.7 'g' |
| Thrust efficiency = | 43.8% |
| Energy efficiency = | 27.9% |

Ejector rams have been designed, especially for use with 'hot gas' (i.e. as generated by a pyrotechnic gas generator or 'cartridge'), to ensure that the highest pressure acts upon the smallest area first, (see UK patent GB 2 078 912 B and FIG. 4*a* herein) but even this is an incomplete solution because eventually, the volume masked from the high pressure gas during the first stage of ram extension is suddenly exposed to the gas, and the resultant expansion and depressurisation negates much of the advantage of having a larger working area during the second stage. Again, a further modest improvement in energy output is obtained, but the resultant force/stroke characteristic is still far from ideal, and is shown in FIG. 4*b* and Table 4.

TABLE 4

| | |
|---|---|
| Work done first stage = | 4535 j |
| Work done second stage = | 1767 j |
| Total work done = | 6302 j |
| Mass final velocity = | 9.08 m/s |
| Average effective force = | 10870 N |
| Peak force/Average effective force = | 2.02 |
| Peak acceleration = | 144 $m/s^2$ |
| Peak 'g' = | 14.7 'g' |
| Thrust efficiency = | 49.4% |
| Energy efficiency = | 31.5% |

U.S. Pat. No. 4,850,553 (E. K. Takata et al, see FIG. 5*a*herein) proposes a telescopic piston which extends in a desirable manner, giving an improvement in efficiencies, but which still has two deficiencies:

a) It is structurally complex and, because the slenderest ram component extends first, does not maximise lateral stiffness.

b) The internal volume of the ram is still excessive because the smaller piston is filled with gas before any useful work is done by the ram.

Figure 5A:
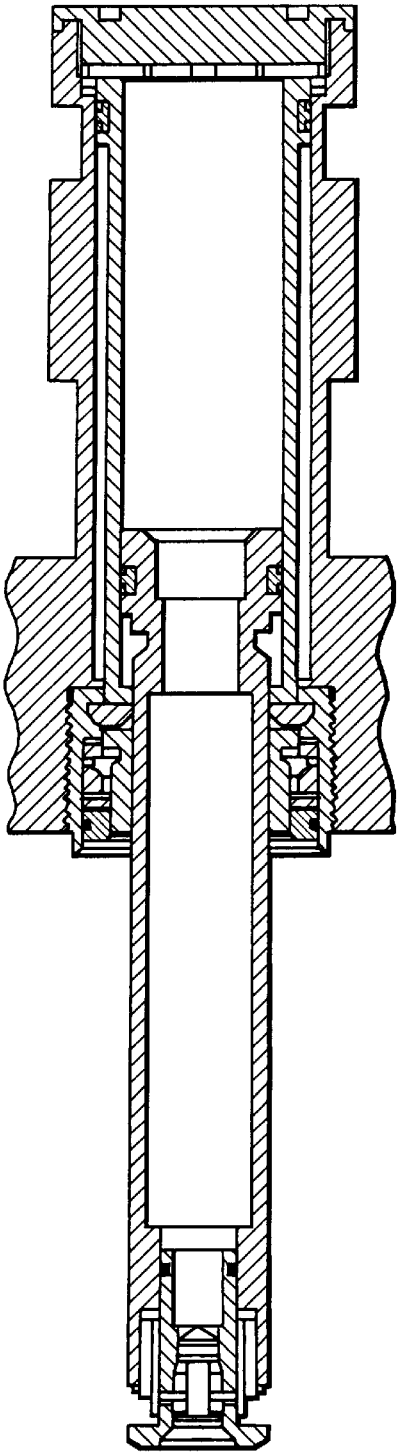
Figure 5B:
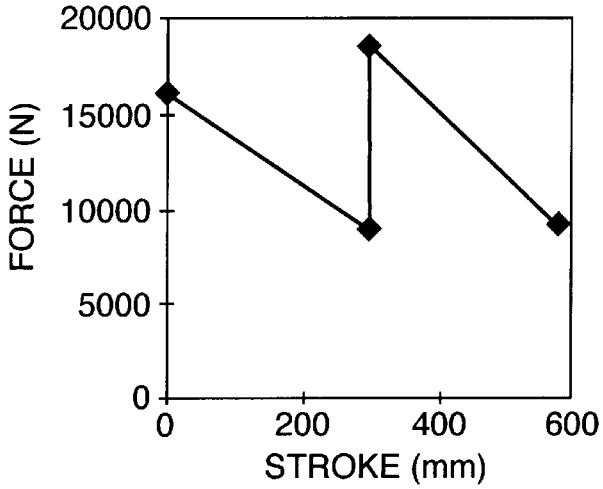

An estimate of the performance characteristics of such a device is shown at FIG. 5*b* and Table 5.

TABLE 5

| | |
|---|---|
| Work done first stage = | 3546 j |
| Work done second stage = | 3525 j |
| Total work done = | 7071 j |
| Mass final velocity = | 9.61 m/s |
| Average effective force = | 12190 N |
| Peak force/Average effective force = | 1.51 |
| Peak acceleration = | 120 $m/s^2$ |
| Peak 'g' = | 12.3 'g' |
| Thrust efficiency = | 66.2% |
| Energy efficiency = | 35.4% |

The Invention

The invention provides a piston assembly comprising an inner component, an intermediate component and an outer component, all telescopingly interfitted together, the inner component comprising a fluid outlet at one end, the intermediate component making a sliding seal with the inner component and comprising a closed end surrounding the fluid outlet end, the outer component making a first sliding seal with the intermediate component and a second sliding seal with the inner component, and a detent operative to hold the outer component in an extended position relative to the inner component.

This arrangement can offer a reduced size gas storage volume, and/or a significant improvement in energy efficiency compared with conventional art, by providing a more sustained thrust from the extending 'ram' in a manner which will be described hereunder. This may be achieved without compromise to the structural efficiency of the ram assembly under the influence of lateral forces during extension.

Figure 2A:
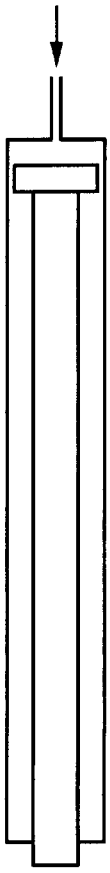
Figure 2B:
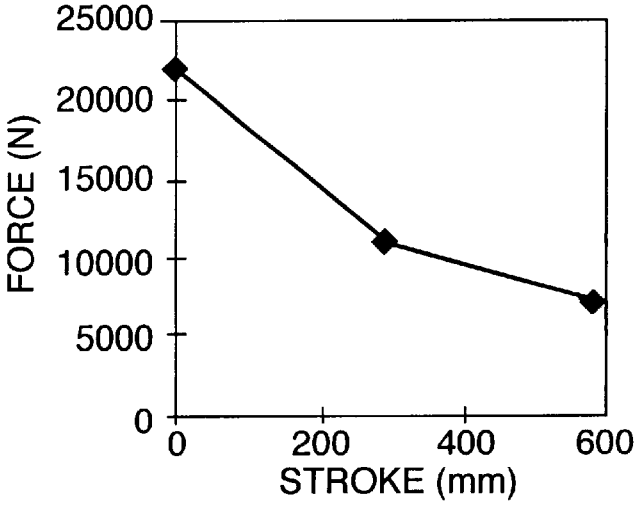
Figure 3B:
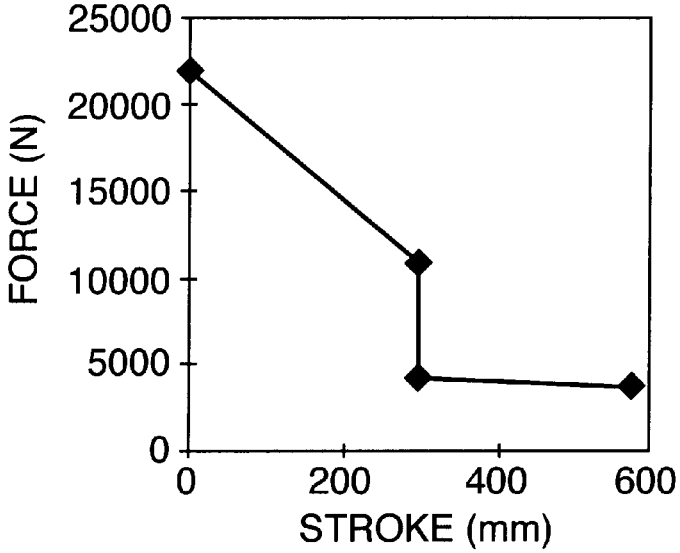
Figure 4A:
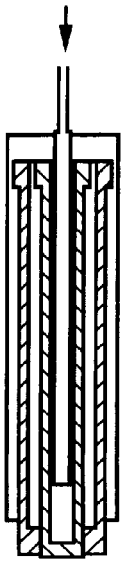
Figure 4B:
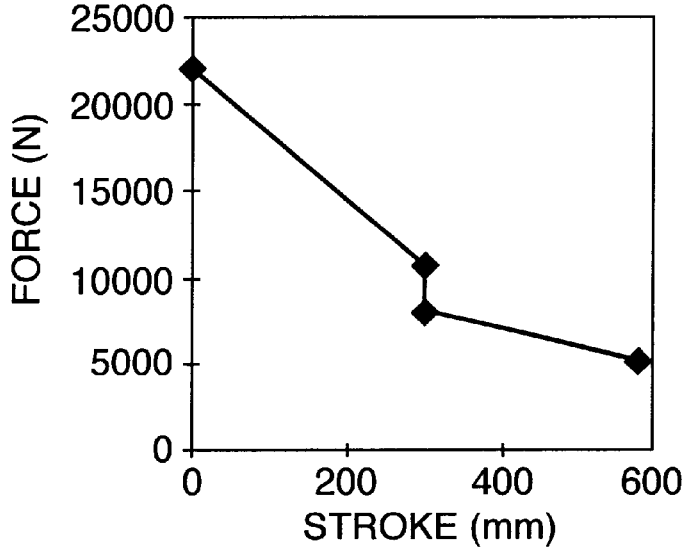
Figure 9:
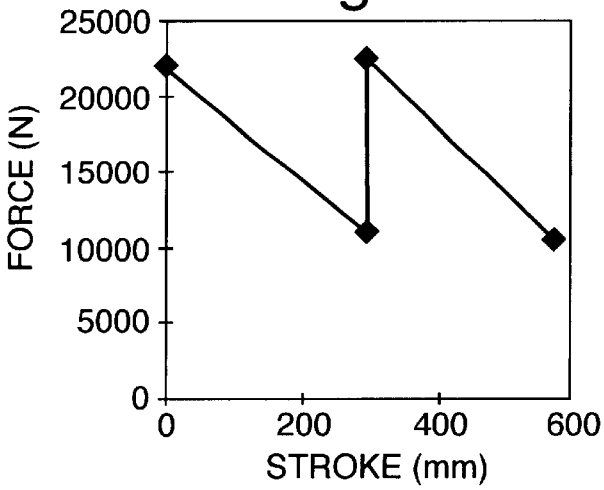
Figure 6:
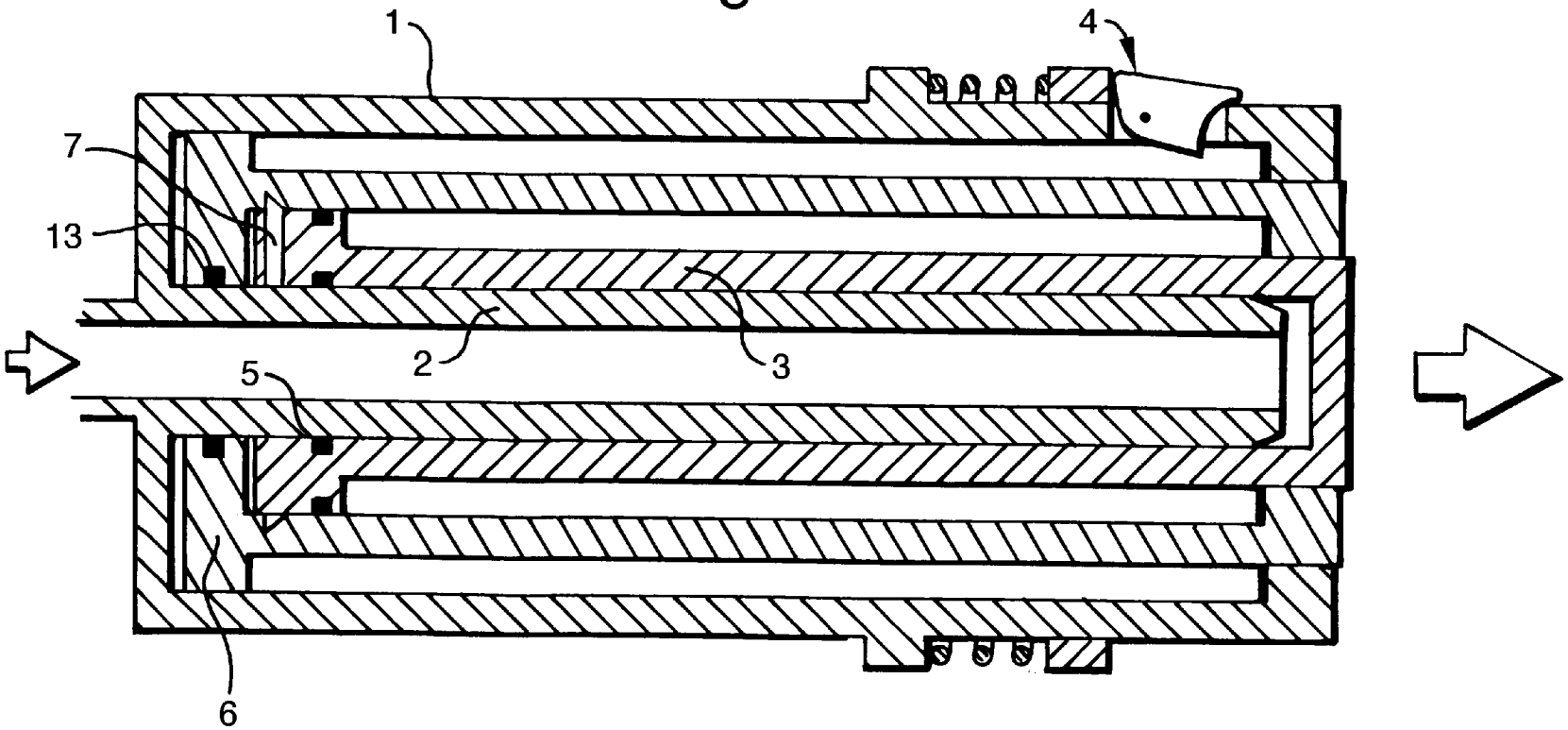
Figure 7:
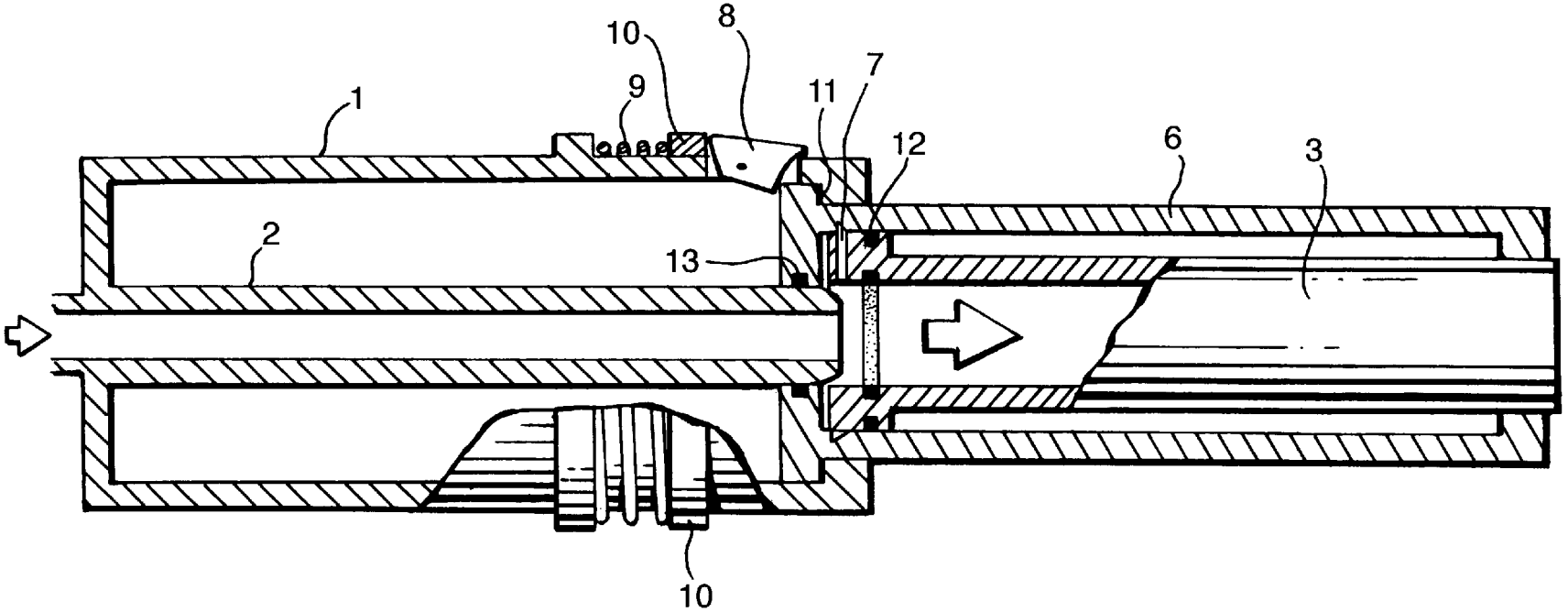
Figure 8:
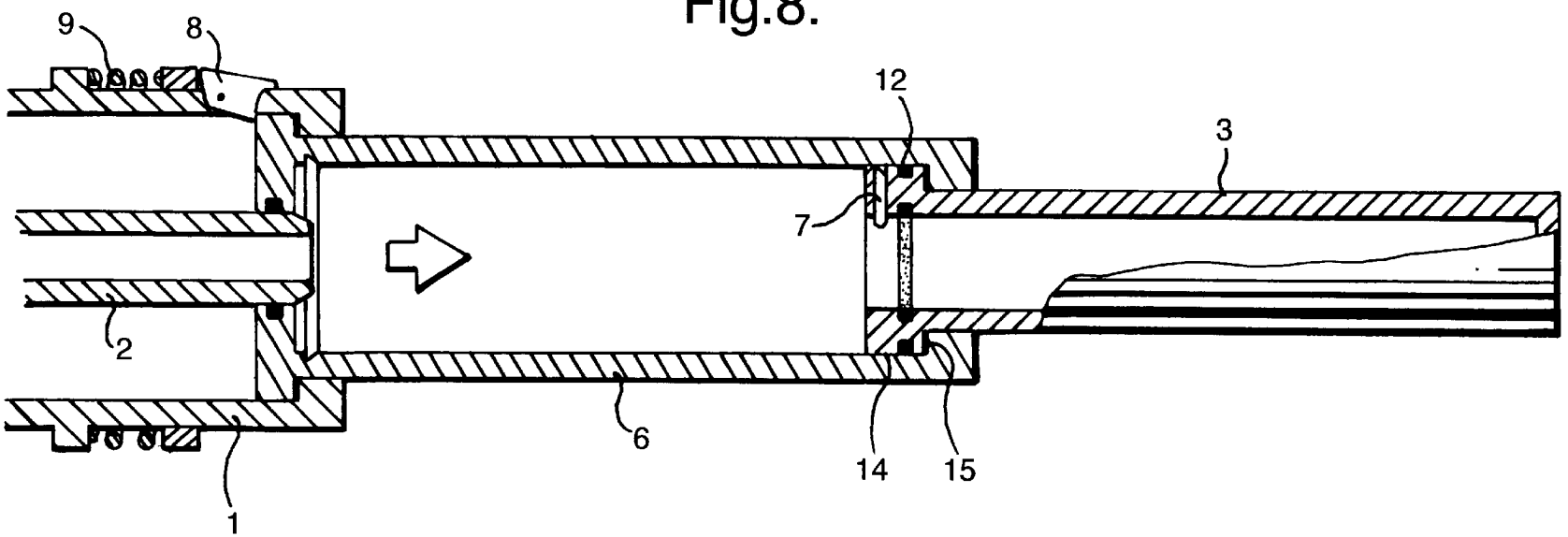

A feature of this invention is to provide the benefits of high gas pressure acting on a small area, followed by a lower pressure acting on a larger area, but without the intermediate expansion (as in FIG. 4*a*) which degrades the second stage starting pressure to an excessive extent, and without exposing the slenderest piston first. Further preferred features and advantages are in the dependent claims or will be apparent from the following description of illustrative embodiments made with reference to FIGS. 6–9 and in comparison with the above described prior art. To partially recap:

FIG. 1*a* shows a single stage piston/cylinder and FIG. 1*b* the corresponding force/stroke characteristic for a given gas volume, starting pressure, load mass and maximum permitted force;

FIGS. 2*a* and 2*b* correspond to FIGS. 1*a* and 1*b* but for a longer piston/cylinder;

FIGS. 3*a* and 3*b* correspond to FIGS. 1*a* and 1*b* but relate to a simple telescopic piston and cylinder assembly;

FIGS. 4*a* and 4*b* correspond to FIGS. 1*a* and 1*b* but relate to a telescopic piston of the type shown in GB 2078912;

FIGS. 5*a* and 5*b* correspond to FIGS. 1*a* and 1*b* but relate to a telescopic piston of the type shown in U.S. Pat. No. 4,850,553;

FIGS. 6, 7 and 8 show a telescopic piston embodying the invention, in fully retracted, partially extended and fully extended states respectively; and FIG. 9 illustrates the force/stroke characteristic of the piston of FIGS. 6–8, for the above given initial gas pressure and volume, load mass and maximum permitted force.

Referring to FIGS. 6–8, a housing 1 provides structural support for the moving components and features a fixed inner component in the form of a gas entry sleeve 2 whose purpose is inter alia to carry high pressure gas to the end of the intermediate component, i.e. a hollow piston 3. Mounted in the outer casing 1 is a latching system 4 forming the detent for the outer component or hollow cylinder 6.

The area on which gas initially acts is defined by the outer diameter of the entry sleeve 2, which engages on a sliding gas seal 5 in the inner wall of the piston 3 to contain the gas during the first stage of telescopic extension. The cylinder 6 is sealed to the entry sleeve 2 by a sliding gas seal 13 so that relative movement between piston 3 and cylinder 6 will tend to create a partial vacuum in the sealed space between these components, with the result that atmospheric pressure acting on the left hand end of cylinder 6 as illustrated in FIG. 6 will cause it to tend to move with the piston 3 as desired. This movement may be satisfactory under ideal conditions with low frictional forces, lightweight moving components and low ram extension speeds. However, for a more positive interengagement, the hollow piston 3 is latched to the cylinder 6 so that said cylinder is reliably transported with the piston during the first stage of extension. A series of radial latching elements 7 engage in a triangular sectioned groove made in the internal diameter of the cylinder, and are prevented from disengaging before the end of the first extension stage by the outer diameter of the gas entry sleeve 2. In this way, the piston 3 and the cylinder 6 move as a single assembly during the first stage.

When the staging point is reached (FIG. 7), the latching elements 7 clear the entry sleeve 2 and are free to move toward the centre of the piston, thereby releasing the piston 3 from the cylinder 6. At the same time, seal 5 clears the entry sleeve 2, allowing gas to enter the gap between the larger end of the piston 3 and the adjacent face of the cylinder 6 end, thereby applying an end load on these two components, attempting to separate them. The cylinder 6, however, is prevented from moving in a reverse direction by multiple pivoting dogs 8 of the latching system 4 (only one dog shown) which have engaged the cylinder 6 right hand end under the action of a spring 9 and collar 10 as the cylinder 6 is arrested by a resilient buffer 11. The dogs 8 are distributed about the circumference of the housing 1.

The gas is now contained by the piston 3, the sleeve 2, the seal 12 on the piston outer diameter and the seal 13 between the cylinder 6 and the sleeve 2 outer diameter. The piston 3, however, is free to continue it movement and travels the length of the cylinder 6 bore under the motivation provided by the gas acting now on the larger diameter of the piston head. The final position of the components is depicted in FIG. 8 in which the piston head 14 contacts a buffer 15 in the right hand end of the cylinder 6. By careful sizing of the piston outer and inner diameters, they may be matched to the volume of gas available at the start to give the same force at the beginning of the first FIG. 6) and second (FIG. 7) stages.

The performance characteristic of this design, for comparison with those described previously, is shown in FIG. 9 and table 9. It will be noted that the invention claimed herein is significantly superior to all other options in terms of energy efficiency, and comes close to the single stage ram (but far excels over the other telescopic designs) in terms of thrust efficiency. This latter result is particularly good for an actuator with nearly twice the stroke of the equivalently sized simple piston.

TABLE 9

| | |
|---|---|
| Work done first stage = | 4535 j |
| Work done second stage = | 4085 j |
| Total work done = | 8620 j |
| Mass final velocity = | 10.6 m/s |
| Average effective force = | 14860 N |
| Peak force/Average effective force = | 1.50 |
| Peak acceleration = | 146 $m/s^2$ |

TABLE 9-continued

| | |
|---|---|
| Peak 'g' = | 14.8 'g' |
| Thrust efficiency = | 66.8% |
| Energy efficiency = | 43.1% |

Table 10 sumarises the performance characteristics of each of the described prior art piston designs and the FIGS. 6–8 embodiment for comparison.

TABLE 10

| Type of Piston Design | Installed length (mm) | Thrust Efficiency (%) | Energy Efficiency\ (%) | Mass Final Velocity (m/s) |
|---|---|---|---|---|
| Single Stage Short (FIG. 1a) | 350 | 68.7 | 22.7 | 7.7 |
| Single Stage Long (FIG. 2a) | 630 | 54.0 | 34.5 | 9.5 |
| Simple Telescopic (FIG. 3a) | 350 | 43.8 | 27.9 | 8.5 |
| Staged Telescopic (FIG. 4a) | 350 | 49.4 | 31.5 | 9.1 |
| Takata et al. (FIG. 5a) | 350 | 66.2 | 35.4 | 9.6 |
| FIGS. 6–8 Embodiment of the Invention | 350 | 66.8 | 43.1 | 10.6 |

What is claimed is:

1. A piston assembly comprising an inner component, an intermediate component and an outer component, all telescopingly interfitted together, the inner component comprising a fluid outlet at one end, the intermediate component and outer component being slidable on and making a sliding seal with the inner component, the intermediate component comprising a closed end surrounding the fluid outlet end, and the outer component making a sliding seal with the intermediate component and being coupled to the intermediate component for movement together relative to the inner component but not to each other during a first extension stage of the piston assembly, wherein the piston assembly further comprises a detent operative to hold the outer component in an extended position relative to the inner component during a subsequent extension stage of the piston assembly in which the intermediate component is extended relative to the outer component.

2. An assembly as defined in claim 1 wherein the inner component is mounted on or integrally formed with a housing which surrounds the outer component in its retracted state.

3. An assembly as defined in claim 2 wherein the detent is mounted at a distal end of the housing.

4. An assembly as defined in claim 1 wherein the intermediate component and outer component are coupled by a radial latching element engageable in a groove made in the internal diameter of the outer component and is prevented by the outer diameter of the inner component from disengaging from the groove until the end of the first extension stage.

5. A piston assembly comprising an inner component, an intermediate component and an outer component, all telescopingly interfitted together, the inner component comprising a fluid outlet at one end, the intermediate component making a sliding seal with the inner component and comprising a closed end surrounding the fluid outlet end, the outer component making a first sliding seal with the intermediate component and a second sliding seal with the intermediate component, wherein the intermediate component is latched to the outer component by a radial latching element so that the outer component is transported with the intermediate component during an initial stage of piston extension, wherein the radial latching element is engageable in a groove made in the internal diameter of the outer component and is prevented by the outer diameter of the inner component from disengaging from the groove until the end of the initial extension stage, wherein the assembly farther comprises a detent operative to hold the outer component in an extended position relative to the inner component.

* * * * *